106-74 AU 119 EX
11/4/86 XR 4,620,904

United States Patent [19]
Kozak

[11] Patent Number: 4,620,904
[45] Date of Patent: Nov. 4, 1986

[54] METHOD OF COATING ARTICLES OF MAGNESIUM AND AN ELECTROLYTIC BATH THEREFOR

[76] Inventor: Otto Kozak, 1089 W. Park Ave., Long Beach, N.Y. 11561

[21] Appl. No.: 791,574

[22] Filed: Oct. 25, 1985

[51] Int. Cl.[4] ..... C25D 11/00
[52] U.S. Cl. ..... 58.4; 106/74
[58] Field of Search ..... 204/56 M; 106/74

[56] References Cited

U.S. PATENT DOCUMENTS 3,996,115 12/1976 Kessler ..... 204/56 M

*Primary Examiner*—R. L. Andrews

[57] ABSTRACT

An electrolytic bath for coating articles of magnesium and its alloys consists essentially of an aqueous solution containing an alkali metal silicate (e.g., potassium silicate), an alkali metal hydroxide (e.g., potassium hydroxide) and a fluoride (e.g., hydrofluoric acid). In the process, the magnesium article is immersed in the bath and an electrical potential is applied between the magnesium article serving as the anode, and a cathode immersed in the bath until a visible spark is discharged on the surface of the metal. The potential difference is maintained for a few minutes until the desired coating thickness is formed.

42 Claims, No Drawings

METHOD OF COATING ARTICLES OF MAGNESIUM AND AN ELECTROLYTIC BATH THEREFOR

FIELD OF THE INVENTION

This invention relates to a method of electrolytic coating of magnesium and its alloys. In one aspect, the present invention relates to an electrolytic coating of magnesium and its alloys to provide a corrosion-resistant, hard, durable, smooth and adherent coating thereon. In another aspect, the present invention is concerned with such coated articles of magnesium and magnesium alloys which are useful for decorative purposes. In still another aspect, this invention relates to an electrolytic bath which is uniquely suited for providing the surfaces of magnesium and its alloys with coatings having the aforementioned properties and characteristics.

BACKGROUND OF THE INVENTION

Magnesium and its alloys have found a variety of industrial applications. However, because of the reactivity of magnesium and its alloys, and their tendency toward corrosition and environmental degradation, it is necessary to provide the surfaces of this metal with an adequate corrosion-resistant and protective coating. Where articles of magnesium or its alloys are used for decorative purposes, the protective coatings applied thereto must be both decorative and corrosion resistant.

The protection of metallic surfaces, including magnesium and its alloys, against corrosion and actions of the elements, has received considerable attention over the years. Some protection has been afforded the metal by coating its surfaces with paint or enamel. Although such coatings are fairly resistant to chemical attack, they are subject to degradation at high temperatures and adhere poorly to the metal surface particularly when experiencing temperature variations.

In order to provide a more effective and permanent protective coating on magnesium and its alloys, the metal has been anodized in a variety of electrolytic solutions. While anodization of magnesium and its alloys imparts a more effective coating than painting or enameling, still the resulting coated metal has not been entirely satisfactory for its intended applications. The coatings often lack the desired degree of hardness, smoothness, durability, adherence and/or imperviousness required to meet the ever-increasing industrial and household demands.

There is a plethora of prior art patents which deal with anodizing magnesium and its alloys. The following is a list of patents which is representative of the efforts of the prior art workers in this field: U.S. Pat. Nos. 1,574,289; 1,574,290; 2,196,161; 2,197,611; 2,203,670; 2,261,960; 2,276,286; 2,305,669; 2,313,753; 2,313,754; 2,313,756; 2,314,341; 2,321,948; 2,322,205; 2,322,208; 2,322,487; 2,338,924; 2,348,826; 2,414,090; 2,426,254; 2,456,931; 2,766,199; 2,778,789; 2,880,148; 3,477,921; 3,620,939; 3,732,152; 3,791,942; 4,184,926; and 4,227,976. While this list is by no means exhaustive, a review of these patents highlights the significant role which the electrolytic solution plays in the anodizing process and in providing the surface of magnesium and its alloys with the desired coating. Thus, in general, the nature and properties of the coating which is formed on aluminum and its alloys depends, to a great extent, on the composition of the anodic bath (electrolytic solution) used in anodizing the metal. Other parameters such as the process conditions used during the electrodeposition process also contribute to the nature and quality of the coating.

In one early patent, i.e., U.S. Pat. No. 1,574,289, a protective coating for magnesium was provided by immersing the metal, which served as the anode, in a solution of hydrofluoric acid and passing a current therethrough at an applied voltage of about 110 volts or higher. The coating formed on the surface of the metal was believed to be magnesium fluoride or oxy-fluoride.

Later, as disclosed in U.S. Pat. No. 2,313,753, it was found that the coatings produced by treatment with hydrofluoric acid alone as aforesaid are unsatisfactory because they are subject to considerable deterioration when exposed to either the atmosphere or aqueous salt solutions. Accordingly, the latter patent recommended that after subjecting the magnesium article to the action of the fluoride, the resulting coated article must be further treated by subjecting it to the action of a bath containing an arsenic compound in order to alter the fluoride-formed coating to increase its corrosion resistance. The dangers of working with arsenic, however, is well known. Besides, this method requires two separate baths and two separate treatments.

A two-step method of providing a protective coating for magnesium and its alloys is also described in U.S. Pat. No. 2,322,208. According to this patent, the magnesium article is first subjected to the action of a fluoride solution and, in a next step, the coated article is immersed in an aqueous solution of a salt of an oxy-acid of an element selected from the group consisting of chromium, molybdemum, phosphorus, selenium, titanium, tugnsten, vanadium, especially the alkali metal and ammonium salts of such oxy-acids.

U.S. Pat. No. 2,322,487 also discloses that when magnesium or its alloys are treated with acid fluoride solution, the resulting coating is subject to deterioration. This patent, too, requires a post-treatment of the fluoride-treated magnesium or its alloys. According to this patent, after treating the metal with an acid fluoride solution, the coated metal is treated, in a separate step, with an aqueous solution of a soluble alkali, or alkali earth metals, such as sodium hydroxide, potassium hydroxide, calcium hydroxide, sodium carbonate, barium hydroxide, and the like.

Even as recently as U.S. Pat. No. 4,184,926 which issued on Jan. 22, 1980 to Otto Kozak (the inventor of the present application), the protective coating on magnesuim and its alloys was formed by separate treatments of the metal; first in a solution of hydrofluoric acid to form a fluoro-magnesium layer on the metal, and then, in a spearate step, by immersing the coated metal in an aqueous solution of an alkali metal silicate, and applying 150 to 350 volts between said coated metal, serving as the anode, and a second metal which serves as a cathode.

While the coating produced by the said Kozak patent exhibits decided advantages with respect to the coatings theretofore obtained by the prior art methods, the resulting coatings are nevertheless not entirely satisfactory. Moreover, the process is rather cumbersome in that it requires two separate baths and the time required to obtain the desired coating is relatively long by industrial standards.

Accordingly, it is an object of this invention to protect the surface of magnesium and its alloys from corrosion and environmental attacks and consequent degradation.

It is a further object of this invention to protect the surfaces of magnesium with hard, uniform, adherent, smooth, impervious and corrosion-resistant coating.

It is yet another object of this invention to provide such coated articles of magnesium and its alloys which can be used for decorative applications.

It is also an object of this invention to provide an improved method for anodic coating of magnesium and its alloys.

It is still another object of this invention to provide such an improved method whereby the protective coating on the surfaces of magnesium and its alloys is achieved in a single bath.

It is yet another object of this invention to provide a unique electrolytic solution for anodic coating of magnesium and magnesium alloys.

It is still another object of this invention to provide an electrolytic solution which is a stable composition under the electrodeposition conditions, and which facilitate the formation of the desired coating without the necessity for a prior fluoride treatment of the metal.

The forgoing and other unique features of the electrolytic solution and the process of this invention will be further described, and more fully appreciated, from the ensuing detailed description.

SUMMARY OF THE INVENTION

The objects of this invention are achieved by providing a unique electrolytic solution comprising certain specified ingredients designed to form a stable anodic bath and facilitate the coating process in a single bath. When used in the process of this invention, the anodic bath is capable of imparting a hard, smooth, uniform, highly adherent and corrosion-resistant coating on magnesium and magnesium alloys which predominate in magnesium. The anodic bath comprises alkali metal silicate, alkali metal, hydroxide and a fluoride compound, notably hydrofluoric acid as essential ingredients. These compounds react synergistically to produce the unique anodic bath and coating of the present invention.

The electrolytic process comprises immersing the magnesium metal or its alloy in the bath, in which the magnesium serves as the anode. A second metal which is cathodic relative to magnesium is also immersed in the bath. Alternatively, the bath is placed in a container which itself is cathodic relative to the magnesium anode. A voltage potential of from about 150 to about 400 volts is then impressed across the electrodes until a visible spark is discharged across the surface of the magnesium, and this voltage is maintained until the desired coating thickness is formed.

DETAILED DESCRIPTION OF THE INVENTION

In accordance with the present invention, there is provided a unique electrolytic solution, sometimes referred to as an electrolytic bath or anodic bath, which is, inter alia, stable, particularly at the high voltages employed during the electrodeposition process, and which imparts the desired coatings to the surfaces of magnesium and its alloys, by treatment in a single bath. As used herein, the terms "magnesium" is intended to denote not only the magnesium metal but also the alloys thereof which predominate in magnesium.

As it was previously noted, there is a plethora of electrolytic solutions or anodic baths which have heretofore been employed for anodic coating of magnesium. The different baths frequently differ from one another with respect to only one or two ingredients. Nevertheless, and in view of the often unpredictable behavior of some chemicals, particularly when they are in admixture with other chemicals, the resulting electrolytic solutions exhibit marked differences in properties and abilities to impart coatings on metal surfaces. Frequently, too, the coatings imparted to the metal surfaces will exhibit significant differences in properties or constitution which reflect the differences in compositions of the electrolytic solution. Therefore, the selection of the ingredients used to form the electrolytic solution is of paramount significance in the anodic treatment of metals.

A. The Electrolytic Solution: It has been discovered that an electrolytic solution having the composition hereinafter described is uniquely suitable for coating magnesium articles with a coating having the properties mentioned previously. In addition, it has been discovered that this electrolytic solution permits coating the magnesium article in a single operation, using a single anodic bath, without the necessity for a prior and separate treatment with hydrogen fluoride as required in the method described in the aforementioned Kozak patents and the other patents which were previously discussed.

A typical electrolytic solution which is especially useful in the practice of this invention contains potassium silicate ($K_2SiO_3$), sodium hydroxide (NaOH), hydrofluoric acid ($HF.H_2O$) and water. Certain other compounds may be used in lieu of, or together with, any of the aforementioned ingredients.

While potassium silicate is the silicate of choice in forming the electrolytic solution, other alkali metal silicates or alkali earth metal silicates can be used, including sodium silicate ($Na_2SiO_3$), lithium silicate ($Li_2SiO_3$), potassium tetrasilicate ($K_2SiO_4$) and potassium fluosilicate ($K_2SiF_6$). Also, hydrofluosilicic acid may be used alone or in conjunction with any of the aforementioned silicates.

Both sodium hydroxide and potassium hydroxide can be used as the alkali metal hydroxide ingredient of the bath. Lithium hydroxide and other alkali metal hydroxides and alkali earth metal hydroxide may be substituted for, or used in admixture with, potassium hydroxide or sodium dydroxide, but the latter two hydroxides are the preferred hydroxide ingredients in preparing the electrolytic solution of the present invention.

An essential feature of the electrolytic solution of this invention is the inclusion therein of hydrofluoric acid. It is believed that the synergistic reaction between hydrofluoric acid and the silicate component of the bath results in a more stable bath, superior coatings on the magnesium article and marked reduction in the time required to provide the desired coating. In lieu of the hydrofluoric acid, or in admixutre therewith, one could use fluosilic acid ($H_2SiF_6$), alkali metal fluoride such as potassium fluoride (KF) and sodium fluoride (NaF).

B. Preparation of the Electrolytic Solution: In preparing the electrolytic bath, the silicate is first added to water, usually at about room temperature. In general, however, the bath temperature is between about 5° C. and about 70° C., but is preferably between about 20° C. and about 40° C. The silicate constitutes the dominant ingredient of the bath and the resulting coating as well. The silicate is added as a 30 Be' solution and various industrial grades silicates are available in this strength. For example, potassium silicate may be used as 30 Be' KASIL 88 solution available from Philadelphia Quartz Co., Philadelphia, Pa. Next, the hydroxide is added, followed by the addition of the hydrofluoric acid.

The relative amounts of the electrolytic bath components may be varied over a wide range with substantially the same effecacious results. Thus, the amount of silicates can vary from about 1 to about 200 cubic centimeters per liter; the hydroxide quantity can be from about 5 to about 50 grams per liter, and the amount of hydrofluoric acid can vary from about 5 to about 30 $cm^3$ per liter.

It must be mentioned that the anodic bath must be highly alkaline and maintained at a pH of from about 12 to about 14. Accordingly, the amounts of the hydrofluoric acid, or the fluoride compound should not be so excessive as to reduce the pH of the bath significantly below about 12.

It must further be mentioned that while the relative amounts of the bath ingredients have been specified with respect to specific components, where the equivalents of any of the aforementioned ingredients are employed, the relative amounts thereof can be selected based on the aforementioned concentration ranges.

The following examples are typical anodic baths which are suitable in the practice of this invention:

EXAMPLE 1

| | |
|---|---|
| $K_2SiO_3$ (30 Be') | 75 $cm^3$ |
| NaOH (granular) | 25 grams |
| $HF.H_2O$ (10% conc.) | 10 $cm^3$ |
| $H_2O$ | 1000 $cm^3$ |

EXAMPLE 2

| | |
|---|---|
| $K_2SiO_3$ (30 Be') | 50 $cm^3$ |
| NaOH (granular) | 25 grams |
| $H_2SiF_6$ | 10 grams |
| $H_2O$ | 1000 $cm^3$ |

EXAMPLE 3

| | |
|---|---|
| $K_2SiO_3$ (30 Be') | 75 $cm^3$ |
| NaOH (granular) | 20 grams |
| NaF | 10 grams |
| KF | 3 grams |
| $H_2O$ | 1000 $cm^3$ |

EXAMPLE 4

| | |
|---|---|
| $Na_2SiO_3$ (25 Be') | 50 $cm^3$ |
| NaOH (granular) | 30 grams |
| $H_2SiF_6$ | 7 grams |
| $H_2O$ | 1000 $cm^3$ |

EXAMPLE 5

| | |
|---|---|
| $H_2SiF_6$ | 30 grams |
| NaOH (granular) | 20 grams |
| $HF.H_2O$ (10% conc.) | 5 $cm^3$ |
| $H_2O$ | 1000 $cm^3$ |

EXAMPLE 6

| | |
|---|---|
| $H_2SiF_6$ | 30 grams |
| KF | 5 grams |
| NaOH (granular) | 15 grams |
| $HF.H_2O$ (10% conc.) | 5 $cm^3$ |
| $H_2O$ | 1000 $cm^3$ |

C. The Coating Process: the magnesium article to be coated is immersed in the electrolytic solution, maintained at a temperature of from about 20° C. to about 40° C., and is made anodic with respect to said bath. A second metal serving as a cathode is also immersed in the bath. Alternatively, the container containing the bath may itself be made cathodic with respect to the magnesium anode. Thereafter, an electric voltage potential of from about 150 volts to about 400 volts is applied between the two electrodes. At such voltage, a visible spark is discharged across the magnesium surface which creates a thermal environment in which the constituents of the bath unite chemically with magnesium to form highly adherent fluoromagnesium-silicate coating. As the aforementioned voltage level is attained, direct current is passed through the electrolytic system at the current density rate of from about 10 mA to about 3 amperes for about 1 to about 5 minutes to form the desired coating.

As it can be seen, the process of this invention does not require pretreatment of the magnesium and the entire operation may be carried out in a single bath. Moreover, the time required to form the desired coating is considerably reduced and is usually about ⅓ to about 1/5 of the time required to form the coating described in the aforementioned Kozak Patent.

While the invention was heretofore described and illustrated with certain degree of specificity, it is apparent to those skilled in the art that some obvious changes and modifications may be made therein, either in the bath or in the electrodeposition process. Such changes and modifications are nevertheless within the scope of this invention and are suggested by the present disclosure.

What is claimed is:

1. A method of coating magnesium and magnesium alloys predominating in magnesium with a hard, adherent, smooth, uniform and corrosion-resistant coating, which method comprises immersing the magnesium or its said alloy in an aqueous electrolytic solution comprising an alkali metal silicate, an alkali metal hydroxide and a fluoride compound, said magnesium or its alloy serving as the anode, immersing a second metal in said electrolytic solution in which said second metal serves as the cathode, applying an electrical potential of from about 150 to about 400 volts between said anode and said cathode until a visible spark is discharged across the surface of said magnesium or its alloy, and maintaining said voltage until the desired coating thickness is formed.

2. A method as in claim 1 wherein said alkali metal silicate is selected from the group consisting of potassium silicate, sodium silicate, lithium silicate, potassium tetrasilicate, potassium fluosilicate and mixtures thereof.

3. A method as in claim 1 wherein said alkali metal hydroxide is selected from the group consisting of potassium hydroxide, sodium hydroxide, lithium hydroxide and mixtures thereof.

4. A method as in claim 1 wherein said fluoride compound is selected from the group consisting of hydrofluoric acid, fluosilicic acid, sodium fluoride, potassium fluoride and mixtures thereof.

5. A method as in claim 1 wherein said alkali metal silicate is potassium silicate or sodium silicate, said alkali metal hydroxide is potassium hydroxide or sodium hydroxide and said fluoride compound is hydrofluoric acid.

6. A method as in claim 1 wherein the electrolytic solution is maintained at a temperature of from about 20° C. to about 40° C. and a pH of from about 12 to about 14.

7. A method as in claim 2 wherein the electrolytic solution is maintained at a temperature of from about 20° C. to about 40° C. and a pH of from about 12 to about 14.

8. A method as in claim 3 wherein the electrolytic solution is maintained at a temperature of from about 20° C. to about 40° C. and a pH of from about 12 to about 14.

9. A method as in claim 4 where the electrolytic solution is maintained at a temperature of from about 20° C. to about 40° C. and a pH of from about 12 to about 14.

10. A method as in claim 5 wherein the electrolytic solution is maintained at a temperature of from about 20° C. to about 40° C. and a pH of from about 12 to about 14.

11. A method of coating magnesium and magnesium alloys predominating in magnesium with a hard, adherent, smooth, uniform and corrosion-resistant coating, which method comprises immersing the magnesium or its said alloy in an aqueous electrolytic solution in a container which serves as the cathode, said aqueous electrolytic solution comprising an alkali metal silicate, an alkali metal hydroxide and a fluoride compound, applying an electrical potential of from about 150 to about 400 volts between said magnesium or its alloy and said container until a visible spark is discharged across the surface of said magnesium or its alloy and maintaining said voltage until the desired coating thickness is formed.

12. A method as in claim 11 wherein said alkali metal silicate is selected from the group consisting of potassium silicate, sodium silicate, lithium silicate, potassium tetrasilicate and potassium fluosilicate and mixtures thereof.

13. A method as in claim 11 wherein said alkali metal hydroxide is selected from the group consisting of potassium hydroxide, sodium hydroxide, lithium hydroxide and mixtures thereof.

14. A method as in claim 11 wherein said fluoride compound is selected from the group consisting of hydrofluoric acid, fluosilicic acid, sodium fluoride, potassium fluoride and mixtures thereof.

15. A method as in claim 11 wherein said alkali metal silicate is potassium silicate or sodium silicate, said alkali metal hydroxide is potassium hydroxide or sodium hydroxide and said fluoride compound is hydrofluoric acid.

16. A method as in claim 11 wherein the electrolytic solution is maintained at a temperature of from about 20° C. to about 40° C. and a pH of from about 12 to about 14.

17. A method as in claim 12 wherein the electrolytic solution is maintained at a temperature of from about 20° C. to about 40° C. and a pH of from about 12 to about 14.

18. A method as in claim 13 wherein the electrolytic solution is maintained at a temperature of from about 20° C. to about 40° C. and a pH of from about 12 to 14.

19. A method as in claim 14 wherein the electrolytic solution is maintained at a temperature of from about 20° C. to about 40° C. and a pH of from about 12 to about 14.

20. A method as in claim 15 wherein the electrolytic solution is maintained at a temperature of from about 20° C. to about 40° C. and a pH of from about 12 to about 14.

21. An electrolytic bath for forming a coating on the surface of magnesium and alloys of magnesium predominating in magnesium, said electrolytic bath consisting essentially of an aqueous solution containing from about 1 to about 200 cm3 per liter of alkali metal silicate, from about 5 to about 50 grams per liter of alkali metal hydroxide and from about 5 to about 30 $cm^3$ per liter of water-soluble fluoride.

22. An electrolytic bath is in claim 21 wherein said alkali metal silicate is selected from the group consisting of potassium silicate, sodium silicate, lithium silicate, potassium tetrasilicate, potassium fluosilicate and mixtures thereof.

23. An electrolytic bath as in claim 21 wherein said alkali metal hydroxide is selected from the group consisting of potassium hydroxide, sodium hydroxide, lithium hydroxide and mixtures thereof.

24. An electrolytic bath as in claim 21 wherein said water-soluble fluoride is selected from the group consisting of hydrofluoric acid, fluosilicic acid, sodium fluoride, potassium fluorides or mixtures thereof.

25. An electrolytic bath as in claim 21 wherein said alkali metal silicate is potassium silicate or sodium silicate, said alkali metal hydroxide is potassium hydroxide or sodium hydroxide and said water-soluble fluoride is hydrofluoric acid.

26. An electrolytic bath as in claim 24 wherein said alkali metal silicate is potassium silicate, said alkali metal hydroxide is potassium hydroxide and said water-soluble fluoride is hydrofluoric acid.

27. A method of coating magnesium and magnesium alloys predominating in magnesium with a hard, adherent, smooth, uniform and corrosion-resistant coating, which method comprises immersing the magnesium or its said alloy in an aqueous electrolytic solution comprising hydrofluosilicic acid, an alkali metal hydroxide and a fluoride compound, said magnesium or its alloy serving as the anode, immersing a second metal in said electrolytic solution in which said second metal serves as the cathode, applying an electrical potential of from about 150 to about 400 volts between said anode and said cathode until a visible spark is discharged across the surface of said magnesium or its alloy, and maintaining said voltage until the desired coating thickness is formed.

28. A method as in claim 27 wherein said alkali metal hydroxide is selected from the group consisting of potassium hydroxide, sodium hydroxide, lithium hydroxide and mixtures thereof.

29. A method as in claim 27 wherein said fluoride compound is selected from the group consisting of hydrofluoric acid, sodium fluoride, potassium fluoride and mixtures thereof.

30. A method as in claim 27 wherein the electrolytic solution is maintained at a temperature of from about 20° C. to about 40° C. and a pH of from about 12 to about 14.

31. A method as in claim 28 wherein the electrolytic solution is maintained at a temperature of from about 20° C. to about 40° C. and a pH of from about 12 to about 14.

32. A method as in claim 29 wherein the electrolytic solution is maintained at a temperature of from about 20° C. to about 40° C. and a pH of from about 12 to about 14.

33. A method of coating magnesium and magnesium alloys predominating in magnesium with a hard, adherent, smooth, uniform and corrosion-resistant coating, which method comprises immersing the magnesium or its said alloy in an aqueous electrolytic solution in a container which serves as the cathode, said aqueous electrolytic solution comprising fluosilicic acid, an alkali metal hydroxide and a fluoride compound, applying an electrical potential of from about 150 to about 400 volts between said magnesium or its alloy and said container until a visible spark is discharged across the surface of said magnesium or its alloy and maintaining said voltage until the desired coating thickness is formed.

34. A method as in claim 33 wherein said fluoride compound is selected from the group consisting of hydrofluoric acid, sodium fluoride, potassium fluoride and mixtures thereof.

35. A method as in claim 33 wherein said fluoride compound is selected from the group consisting of hydrofluoric acid, sodium fluoride, potassium fluoride and mixtures thereof.

36. A method as in claim 33 wherein the electrolytic solution is maintained at a temperature of from about 20° C. to about 40° C. and a pH of from about 12 to about 14.

37. A method as in claim 34 wherein the electrolytic solution is maintained at a temperature of from about 20° C. to about 40° C. and a pH of from about 12 to about 14.

38. A method as in claim 35 wherein the electrolytic solution is maintained at a temperature of from about 20° C. to about 40° C. and a pH of from about 12 to about 14.

39. An electrolytic bath for forming a coating on the surface of magnesium and alloys of magnesium predominating in magnesium, said electrolytic bath consisting essentially of an aqueous solution containing from about 1 to about 200 $cm^3$ per liter of hydrofluosilicic acid, from about 5 to about 50 grams per liter of alkali metal hydroxide and from about 5 to about 30 $cm^3$ per liter of water-soluble fluoride.

40. An electrolytic bath as in claim 39 wherein said alkali metal hydroxide is selected from the group consisting of potassium hydroxide, sodium hydroxide, lithium hydroxide and mixtures thereof.

41. An electrolytic bath as in claim 39 wherein said water-soluble fluoride is selected from the group consisting of hydrofluoric acid, fluosilicic acid, sodium fluoride, potassium fluorides or mixtures thereof.

42. An electrolytic bath as in claim 39 wherein said alkali metal silicate is potassium silicate or sodium silicate, said alkali metal hydroxide is potassium hydroxide or sodium hydroxide and said water-soluble fluoride is hydrofluoric acid.

* * * * *